US009925734B2

(12) United States Patent
Selle et al.

(10) Patent No.: US 9,925,734 B2
(45) Date of Patent: Mar. 27, 2018

(54) METHOD AND APPARATUS FOR MAKING BAGS

(75) Inventors: Paul A. Selle, Appleton, WI (US); Christopher L. White, Watersmeet, MI (US); James F. Campbell, Green Bay, WI (US); Timothy J. Rymer, Appleton, WI (US)

(73) Assignee: CMD Corporation, Appleton, WI (US)

( * ) Notice: Subject to any disclaimer, the term of this patent is extended or adjusted under 35 U.S.C. 154(b) by 1919 days.

(21) Appl. No.: 13/090,733

(22) Filed: Apr. 20, 2011

(65) Prior Publication Data

US 2012/0270713 A1 Oct. 25, 2012

(51) Int. Cl.

| | |
|---|---|
| ***B31B 1/14*** | (2006.01) |
| ***B31B 70/00*** | (2017.01) |
| *B31B 70/64* | (2017.01) |
| *H05F 3/02* | (2006.01) |
| *H05F 3/00* | (2006.01) |
| *H01R 13/648* | (2006.01) |
| *B31B 160/10* | (2017.01) |
| *B31B 70/02* | (2017.01) |

(52) U.S. Cl.

CPC ..... *B31B 70/00* (2017.08); *B31B 70/005* (2017.08); *B31B 70/024* (2017.08); *B31B 70/649* (2017.08); *B31B 2160/10* (2017.08); *H01R 13/6485* (2013.01); *H05F 3/00* (2013.01); *H05F 3/02* (2013.01)

(58) Field of Classification Search

CPC ..... B31B 2201/0294; B31B 1/14; B29C 66/8511; B29C 65/74; B29C 65/02; B29C 65/7885

USPC ..... 493/227, 194, 186, 197, 198, 202, 205, 493/208, 11

See application file for complete search history.

(56) References Cited

U.S. PATENT DOCUMENTS 2,459,260 A * 1/1949 Brown ..... 219/768
3,558,400 A * 1/1971 Horvath et al. ..... 156/359

(Continued)

FOREIGN PATENT DOCUMENTS

CH 559614 A5 3/1975

OTHER PUBLICATIONS

National Fire Protection Agency, NFPA-77 Recommended Practice on Static Electricity. 2007.*

(Continued)

*Primary Examiner* — Hemant M Desai
*Assistant Examiner* — Eduardo R Ferrero
(74) *Attorney, Agent, or Firm* — George R. Corrigan

(57) ABSTRACT

A bag machine includes input, drum, and output sections. The drum has at least one seal bar. The sections are mounted to side frames that are single metal plates, not coated after being formed, and/or are comprised of galvanized steel, galvannealed steel, stainless steel or aluminum. The drum has opposing pairs of rotatable zinc plated steel plates. The distance from the seal bars to the drum center responds to the plates rotating. One plate has non-radial (such as curved and/or spiraled) grooves, and the other radial slots, with fixtures having seal bars in the slots and grooves. The winder has a rotatable turret with center and surface wind and center wind only positions. When one collapsible spindle is in the center and surface wind position, another is in the center wind only position. A push off palm mounted in a push off position.

11 Claims, 8 Drawing Sheets

(56) References Cited

U.S. PATENT DOCUMENTS

| | | | | | |
|---|---|---|---|---|---|
| 4,036,676 | A * | 7/1977 | Pennington | 156/274.4 |
| 4,221,347 | A * | 9/1980 | Hill | 242/574.3 |
| 4,231,558 | A * | 11/1980 | Aterianus et al. | 270/60 |
| 4,642,084 | A | 2/1987 | Geitman | |
| 4,791,524 | A * | 12/1988 | Teigen et al. | 361/212 |
| 4,867,735 | A * | 9/1989 | Wogelius | 493/197 |
| 4,906,228 | A * | 3/1990 | Reifenhauser et al. | 493/196 |
| 4,934,993 | A * | 6/1990 | Gietman, Jr. | 493/11 |
| 5,046,537 | A * | 9/1991 | Maina | 139/452 |
| 5,215,514 | A * | 6/1993 | Flyghagen et al. | 493/193 |
| 5,232,430 | A * | 8/1993 | Nitsch | 493/341 |
| 5,447,486 | A * | 9/1995 | Anderson et al. | 493/11 |
| 5,518,559 | A | 5/1996 | Saindon et al. | |
| 5,587,032 | A | 12/1996 | Saindon et al. | |
| 5,660,674 | A * | 8/1997 | Saindon et al. | 156/353 |
| 5,671,783 | A * | 9/1997 | Zenoni et al. | 139/452 |
| 5,738,618 | A * | 4/1998 | Lemerand et al. | 493/208 |
| 5,772,565 | A * | 6/1998 | Weyandt | 493/8 |
| 5,830,117 | A * | 11/1998 | Anderson | 493/193 |
| 5,899,403 | A | 5/1999 | Geitman et al. | |
| 6,004,252 | A * | 12/1999 | Blaser | 493/204 |
| 6,117,058 | A | 9/2000 | Sauder et al. | |
| 6,186,436 | B1 | 2/2001 | Selle et al. | |
| 6,648,044 | B2 * | 11/2003 | Bohn et al. | 156/515 |
| 6,997,722 | B2 * | 2/2006 | Mangold | 439/92 |
| 7,326,162 | B2 * | 2/2008 | Sauder et al. | 493/34 |
| 7,367,931 | B2 * | 5/2008 | Barclay et al. | 493/341 |
| 7,445,590 | B2 * | 11/2008 | Selle et al. | 493/200 |
| 7,578,779 | B2 * | 8/2009 | Selle | 493/193 |
| 8,257,236 | B2 * | 9/2012 | Selle et al. | 493/341 |
| 2002/0058574 | A1 * | 5/2002 | Sauder et al. | 493/269 |
| 2007/0045463 | A1 * | 3/2007 | White | 242/533.4 |
| 2007/0167304 | A1 * | 7/2007 | Selle et al. | 493/175 |
| 2007/0179035 | A1 * | 8/2007 | Selle et al. | 493/189 |
| 2007/0179036 | A1 * | 8/2007 | Selle et al. | 493/189 |
| 2007/0243738 | A1 * | 10/2007 | Smadi et al. | 439/181 |
| 2008/0067279 | A1 * | 3/2008 | Selle | 242/526 |
| 2008/0094774 | A1 * | 4/2008 | Bucciferro | 361/220 |
| 2008/0096440 | A1 * | 4/2008 | Waltz et al. | 439/816 |
| 2008/0119340 | A1 * | 5/2008 | Selle et al. | 493/11 |
| 2008/0300121 | A1 * | 12/2008 | Selle et al. | 493/189 |
| 2008/0312056 | A1 * | 12/2008 | Selle et al. | 493/197 |
| 2009/0098992 | A1 * | 4/2009 | Selle et al. | 493/194 |
| 2009/0305859 | A1 * | 12/2009 | Selle et al. | 493/197 |
| 2010/0197473 | A1 * | 8/2010 | Selle et al. | 493/11 |
| 2012/0270713 | A1 * | 10/2012 | Selle et al. | 493/227 |

OTHER PUBLICATIONS

PCT/US2012/032737 International Search Report, dated Nov. 2, 2012, European Patent Office, Rijswijk, Netherlands.

PCT/US2012/032737 Partial International Search Report, dated Sep. 3, 2012, European Patent Office, Rijswijk, Netherlands.

* cited by examiner

METHOD AND APPARATUS FOR MAKING BAGS

FIELD OF THE INVENTION

The present invention relates generally to the art of bag making or winding film or bags. More specifically, it relates to a machine and method for making bags using a rotary drum, or a machine and method for winding film or bags.

BACKGROUND OF THE INVENTION

There are many known bag machines. One style is a rotary drum machine. Rotary drum machines are well known, and a detailed description may be found in U.S. Pat. Nos. 7,445,590, 6,117,058, 4,934,993, 5,518,559, 5,587,032 and 4,642,084 (each of which is hereby incorporated by reference).

A detailed description of the operation of rotary bag machines may be found in the patents above, but their general operation may be seen with respect to the Figures of U.S. Pat. No. 6,117,058. The prior art rotary bag machine continuously processes a film/web using a dancer assembly, a pair of drum-in rolls, a sealing drum 208, a pair of drum-out rolls, a sealing blanket, a pair of knife-in rolls, a knife (which could be any other web processing device such as a perforator, knife, die cutter, punching station, or folding station), a pair of knife-out rolls, and a controller. Input section, as used herein, includes the portion of a bag machine where the web is received, such as an unwind and a dancer assembly. Output section, as used herein, includes assemblies that act on a web downstream of the seals being formed, such as perforators, winders, folders, etc.

The web is provided through the dancer assembly to the drum. The drum includes a plurality of seal bars. The seals bars are heated and create the seals forming the bags from the web. The web is held against the drum (and the seals bars) by a Teflon® coated blanket. The distance between seals created by the drum is related to the bag length (for bags formed end to end) or the bag width (for bags formed by making side seals). End to end bags are formed with one seal from the drum, and side to side bags are formed with a pair of seals. The drum diameter may be adjusted and/or less than all of the seal bars turned on to determine the distance between seals, and hence bag size. The drum diameter is adjusted using threaded rods. The prior art of FIG. 1 provides that after the web leaves the drum it is directed to the rotary knife which creates a perforation between bags, or could separate adjoining bags. U.S. Pat. No. 7,445,590 teaches to make the perforation on the drum.

Prior art machines typically included discrete input, sealing and output sections. Each discrete section was supported by a frame dedicated to that section. Frames were typically painted or otherwise coated, and could be sections bolted together, tubular steel, etc. Finish coatings have included primer, paint, nickel, zinc, chrome, or the like. Each section could be 15-20 feet or more in length. Because of the size of each section, frames were typically too large to be dipped for galvanizing.

Bag machines often include a downstream winder. Prior art winders are described in U.S. Pat. Nos. 6,186,436, 5,899,403 and 7,578,779 and US Patent Publication 20070045463, each of which is hereby incorporated by reference. Prior art winders often include three spindles mounted on a turret. One turret was in a transfer or initial wind position where the film is initially wound onto the turret, a winding position where most of winding is performed, and a push off position. The winding position provides for center and surface wind. The turret rotates and spindles are moved to each position. Three spindles are needed to provide the desired cycle rate and machine speed. The push off position is above the transfer and winding positions, which can result in a removed roll affecting the winding of a subsequent roll if the removed roll falls to the floor. The wound roll of bags is removed from the spindle. Prior art spindles can be tapered, and/or have air flowing through holes in the surface to facilitate removal.

A method and machine for making bags that provides a simple, compact design is desired. The machine preferable includes the input, drum and output section supported by a single common frame. The drum section preferably includes an adjustable drum, that is able to be economically manufactured. The output section preferably includes a winder that has a turret with multiple spindles, including a position for removing wound rolls that allows for rolls to be removed without interfering with the winding process. Winding is preferably performed with center and surface winding for much of the roll. The spindles preferably have a design that allows for easy removal of wound rolls.

SUMMARY OF THE PRESENT INVENTION

According to a first aspect of the invention a method or machine for making bags from a film includes an input section, a a drum section, and an output section. The drum section receives the film from the input section, and has least one seal bar on the drum. The seal bar forms bags by sealing the film. The output section is disposed to receive the film from the drum section. The drum section is mounted to first and second side frames. The side frames are each single metal plates.

The first and second side frames are not coated after being formed and/or are comprised of at least one of galvanized steel, galvannealed steel, stainless steel or aluminum, in various embodiments.

The output section includes one or more of a folder, a winder and perforator in various embodiments The drum section includes an adjustable diameter drum, and/or the seal bars include a perforator in other alternatives.

The input and/or output sections are mounted to the first and second side frames in other embodiments.

The first and second side frames are bonding conductors, and/or reduce ESD by providing a bonding paths to ground in various embodiments.

According to a second aspect of the invention a method or machine for making bags from a film includes an input section, a drum section, and an output section. The drum section receives film from the input section, and includes at least one seal bar on a drum, wherein the at least one seal bar forms bags by sealing the film. The drum is comprised of a first and second plate, and an opposing third and fourth plate. The first plate is rotatable with respect to the second plate, and the third plate is rotatable with respect to the fourth plate. The distance from the seal bars to the center of the drum is responsive to the rotation of the plates. The output section receives the film from the drum section.

The first and fourth plates and/or second and third plates are coupled such that rotation of the first plate with respect to the second plate is coupled to rotation of the fourth plate with respect to the third plate in one embodiment.

The first and second plates on one side of a film path and the third and fourth plates are on an opposite side of the film path in another embodiment.

The first plate has a plurality of non-radial grooves, and the second plate has a plurality of radial or non-radial slots, with fixtures in the slots and grooves in another embodiment. The fixtures are connected to seal bars. Thus, rotating the first plate with respect to the second plate causes the associated fixture to move in the associated slot and the associated groove whereby that the distance from the associated seal bar to the center of the drum changes.

The non-radial grooves are curved and/or spiral in various embodiments.

The plates are comprised of zinc plated steel and/or are discs in various embodiments.

According to a third aspect of the invention a bag winder or method of winding bags includes a rotatable turret with a center and surface wind position, and a center wind only position. Two spindles are cantilever mounted on the turret. When one spindle is in the center and surface wind position, the other spindle is in the center wind only position.

A push off palm mounted in a push off position in one embodiment, and a 360 degree scraper is provided on each spindle in another embodiment.

The turret rotates about a horizontal axis, and/or the center and surface wind position is not below the push off position, and/or the center and surface wind position and the center wind only position are in a horizontal plane, and/or the push off position is in the same location as the center wind position in various embodiments.

According to a third aspect of the invention a bag winder or method of winding bags includes a rotatable turret having at least one spindle cantilever mounted thereon. The spindle includes a first portion that is radially collapsible.

The first portion is comprised of two opposing pieces, with a bladder disposed inside at least one of the pieces, such that inflating the bladder increases the circumference of the first portion, and deflating the bladder decreases the circumference of the first portion in one embodiment. The second portion can have a hollow interior fluidly connected to the bladder, so that fluid can be provided to and removed from the bladder through the interior of the second portion.

The two opposing pieces each have a semi-annular shape in another embodiment.

The spindle has a second portion that is not collapsible in another embodiment.

The first and/or second portions have a tapered shape in another embodiment.

Other principal features and advantages of the invention will become apparent to those skilled in the art upon review of the following drawings, the detailed description and the appended claims.

Figure 1:
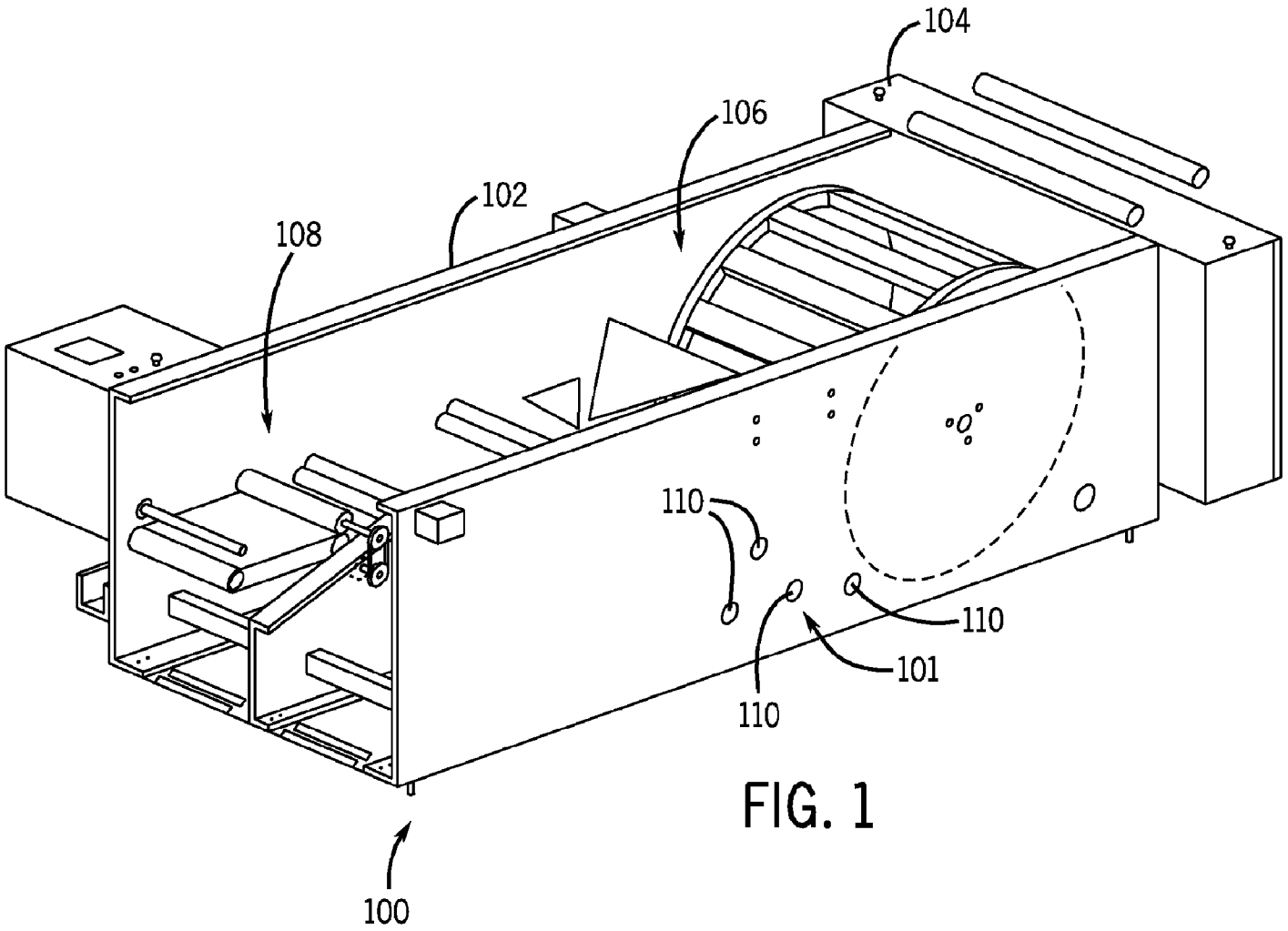
FIG. 1 is perspective view of a bag machine in accordance with the preferred embodiment.

Before explaining at least one embodiment of the invention in detail it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. Like reference numerals are used to indicate like components.

DETAILED DESCRIPTION OF THE PREFERRED EMBODIMENTS

While the present invention will be illustrated with reference to a particular machine and method, it should be understood at the outset that the invention can also be implemented with other designs and other steps.

The invention provides for a bag machine that is compact and economical to manufacture. The machine preferably include a common frame (or two common side plates) for the input, drum, and output sections. Each side plate is preferably a single piece, that is galvannealed, galvanized, etc., and that does not need to be coated or painted after being cut or formed. The compactness of the design allows for dipping and galvanizing.

The drum preferably has an adjustable diameter to change bag lengths, and the manner of construction preferably allows it to be economically made. Specifically, the preferred embodiment provides for two pair of opposing plates. One plate of each pair has slots, and the other grooves. The slot and grooves are angled with respect to one another. The seal bars for the drum are mounted to fixtures that slide in the slots and grooves. Thus, as the plates are rotated with respect to one another, the location of the fixture, and the distance of the seal bar from the center of the drum changes.

The bag machine preferable includes a winder, and the winder preferably includes a turret with two spindles. The turret has an initial wind position, where most of the winding occurs, and where the winding is center and surface winding. The turret has a final wind position, where the remainder of the winding occurs, and is center wind only. Thus, most of the winding is center and surface winding, which provides for a tight wind, but the outer portion is center wind only, which may be looser. The turret preferably includes a push off position that is not above the winding positions. Thus, the rolls can fall to the floor without hitting a winding spindle. The spindles preferable have a collapsible design, to allow for easier removal of wound rolls.

Referring now to FIG. 1, a perspective view of a bag machine 100 includes two side frames 101 and 102, an input section 104, a drum section 106 and an output section 108. Input section, as used herein, is the section of a bag machine where the film is provided, extruded, unwound, etc. Drum section, as used herein, is the section of a bag machine where the film is sealed to form bags. Output section, as used herein, is the section of a bag machine where the film is processed after sealing, and can include folding, perforating, winding, etc. Alternative embodiments provide for more or fewer of these sections.

Side frames 101 and 102 are each comprised of a single metal plate. The single metal plate is preferably galvanized steel. The plates may be comprised of galvannealed steel, stainless steel, aluminum, or combinations of these and other materials in various embodiments. Single metal plate, as used herein, is a metal plate without being held together by fasteners such as bolts, screws, rivets, etc.

The various sections are mounted to and between frames 101 and 102. The frames are of a size that allows for dipping and galvanizing. They are not painted or coated after being formed. The frames are formed when the plate is cut, machined, has holes made in it, etc. Because the frame is a single plate, and is not painted or coated after forming, each frame acts as a single bonding conductor, and reduces ESD, and has no poor areas of high frequency noise dissipation bonding surfaces. A third frame member which is a bonding conductor can connect the two side plates for reducing ESD. Bonding, as used herein, is the use of an independent connection between conductors or between a conductor and a dissipative material to provide a path of low electrical impedance for easy migration of charge where this cannot otherwise be ensured. Bonding conductor, as used herein, is a conductor for bonding to provide an effective bonding path to ground for high frequency noise, such as in the 50 kHz-1 Mhz range. Single bonding conductor, as used herein, is a bonding conductor formed from a single metal plate or piece.

Bag machine 100 preferably includes top sliding doors comprised of a polycarbonate resin thermoplastic, and six inch access holes 110. Side plates 101 and 102 are preferably 8 GA (0.1644 in). The dimensions of side frames 101 and 102 are preferably 10 feet long, 39 inches tall, and the machine is preferably 42 inches wide.

Various alternatives provide for the input section and/or the output section to have their own side frames. Also, the drum section can be omitted.

Figure 2:
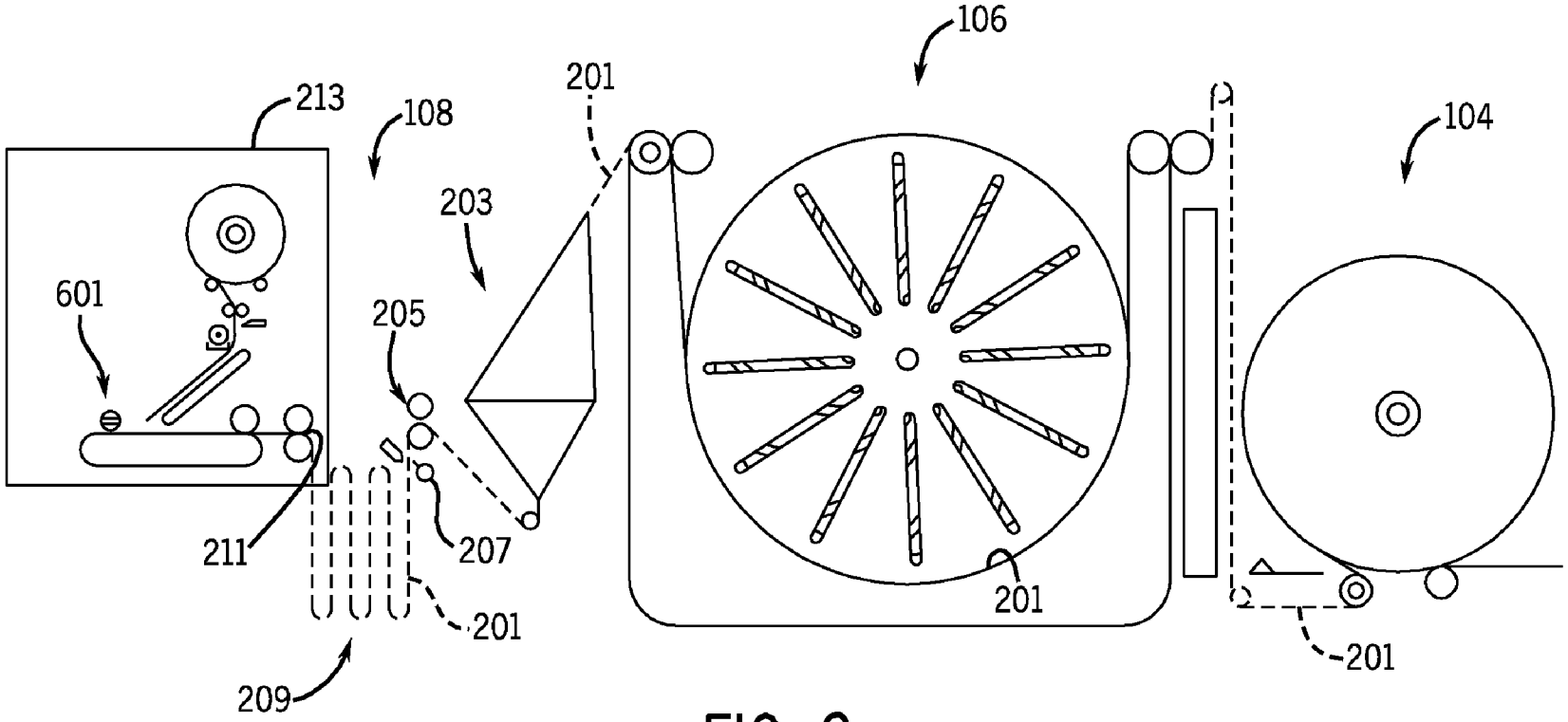
FIG. 2 is diagram of a bag machine in accordance with the preferred embodiment.

Referring now to FIG. 2, a diagram of bag machine 100 and input section 104, drum section 106 and output section 108 shows the path of a tubular film 201. Section 104 includes an unwind. The machine can be a one or two lane machine. Alternative embodiments provide for film being provided through the dancer assembly from an extruder. The film path is from input section 102 to drum section 104.

Drum section 106 includes a drum, with a blanket. The drum is preferably constructed in accordance with the description below, and has at least one seal bar. Preferably there are a plurality of seal bars, and more preferably four seal bars, and with a 38 inch maximum diameter. The drum has an adjustable diameter in the preferred embodiment. Adjustable diameter drum, as used herein, is a drum where the distance between seal bars and the distance from a seal bar to the center of the drum, is adjustable. Alternatives provide for a drum section in accordance with the prior art. The blanket can be a prior art blanket. One embodiment provides for the drum to be omitted, or to have no seal bars, or have seal bars turned off. In such an alternative the machine can be used for sheeting without any seals. The seal bars can be prior art conventional seal bars, or newer prior art seal bars with the perforation formed at the drum.

The film path is from drum section 106 to output section 108. The preferred embodiment provides that output section 108 includes a folder 203, a nip 205, a knife or perforator 207, a dancer 209, a perforation detector 211 and a winder 213. Film path 201 traverses these components in the order listed above. The preferred embodiment uses different components for different applications. Starfolded (prefolded) does not use a folding board nor a nip before the perforator. Lay-flat webs folded over a V-board preferably use a nip prior to the perforator. Folder, as used herein, is a device that is part of or used with a bag machine that folds the film or folds bags after being formed. A winder, as used herein, is a device that is part of or used with a bag machine that winds the film, or winds bags after being formed. A perforator, as used herein, is a device that is part of or used with a bag machine and perforates the film. Dancer (accumulator) 209 is not used in one preferred embodiment.

Folder 203 can be of other than a V-board folder, or omitted in alternative embodiments. Perforator 205 is preferably a knife, and can be a cross web perforator, an in-line perforator, a sine-wave perforator, a diagonal perforator, or other perforators in various embodiments. Perforator 205 can be omitted if the newer seal bars that form perforations are used, or if perforation are not desired. Perforation detector 211 is preferably optical, but can be of another design, or omitted if not desired. Winder 213 is described in greater detail below, but preferably includes a turret with two spindles.

Figure 3:
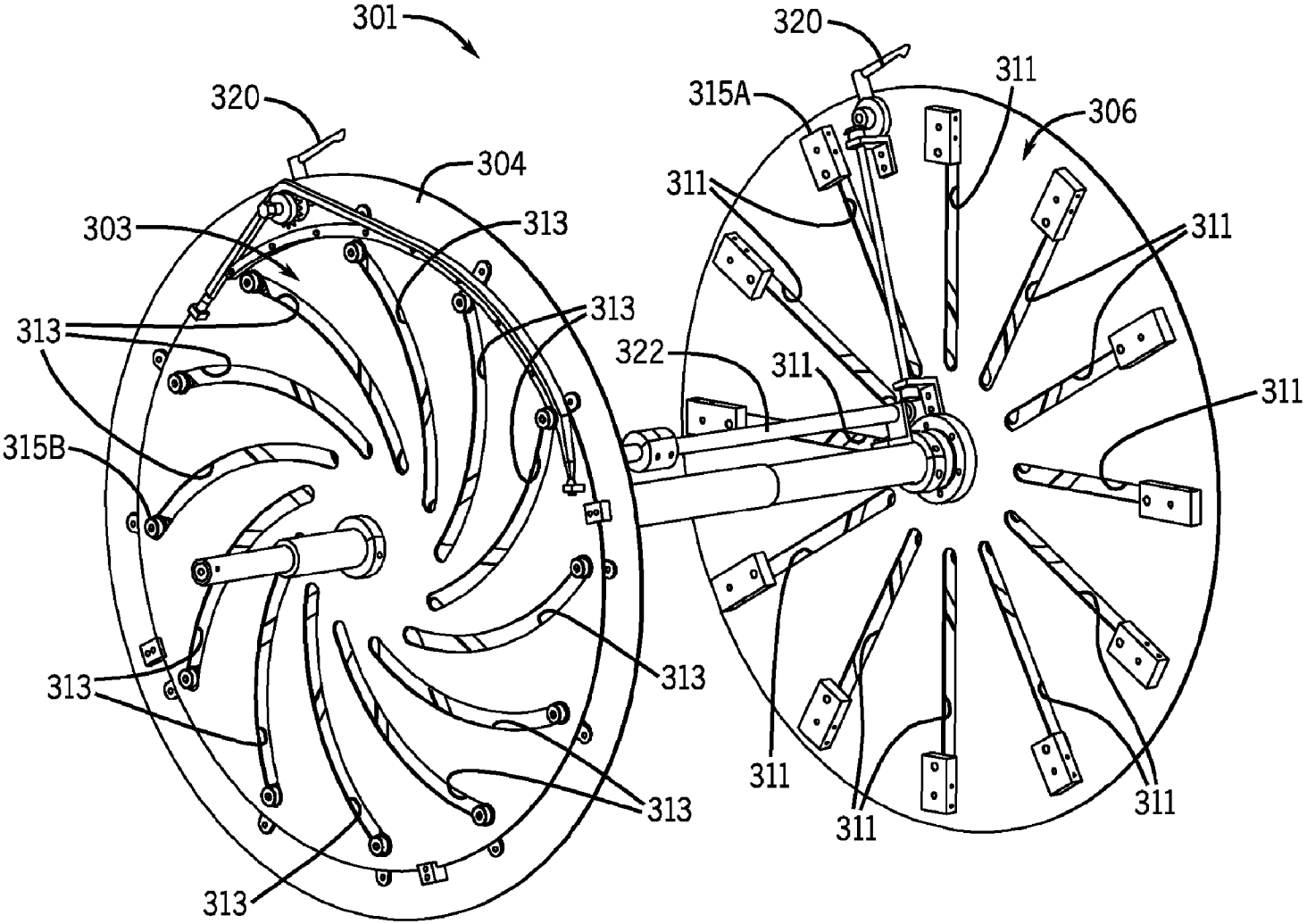
FIG. 3 is a perspective view of a drum in accordance with the preferred embodiment.
Figure 4:
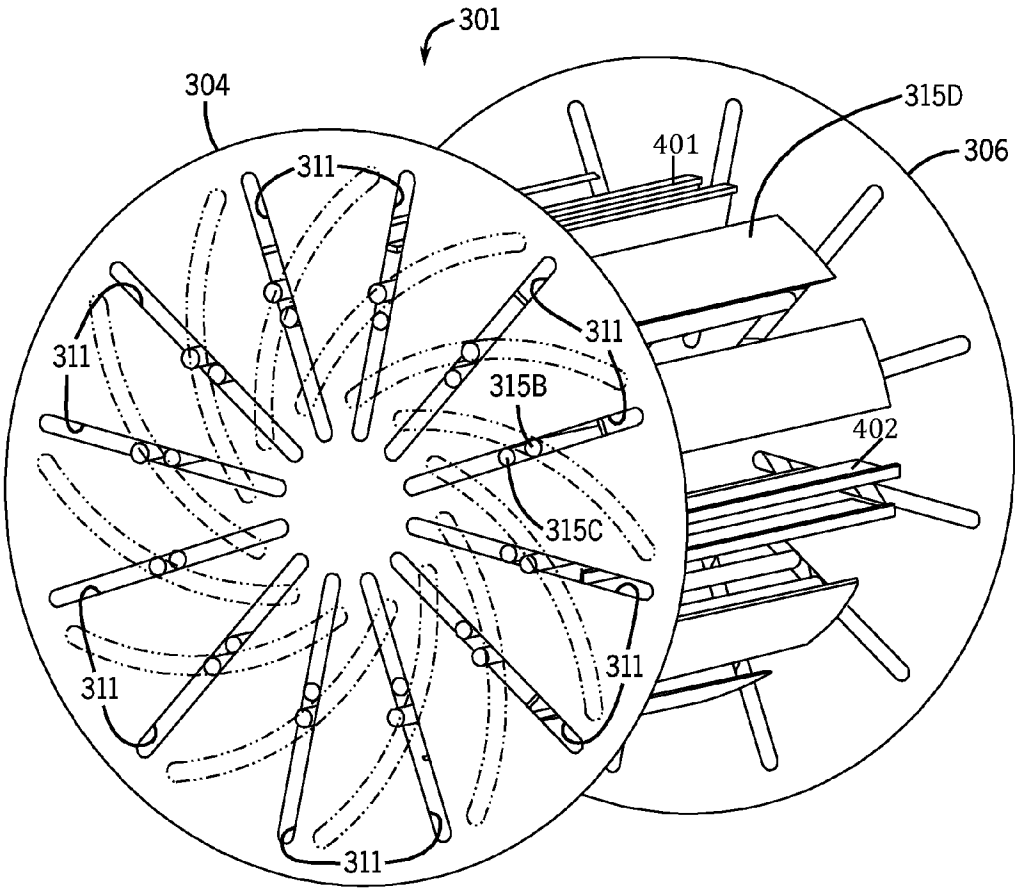
FIG. 4 is a perspective view of a drum in accordance with the preferred embodiment.
Figure 5:
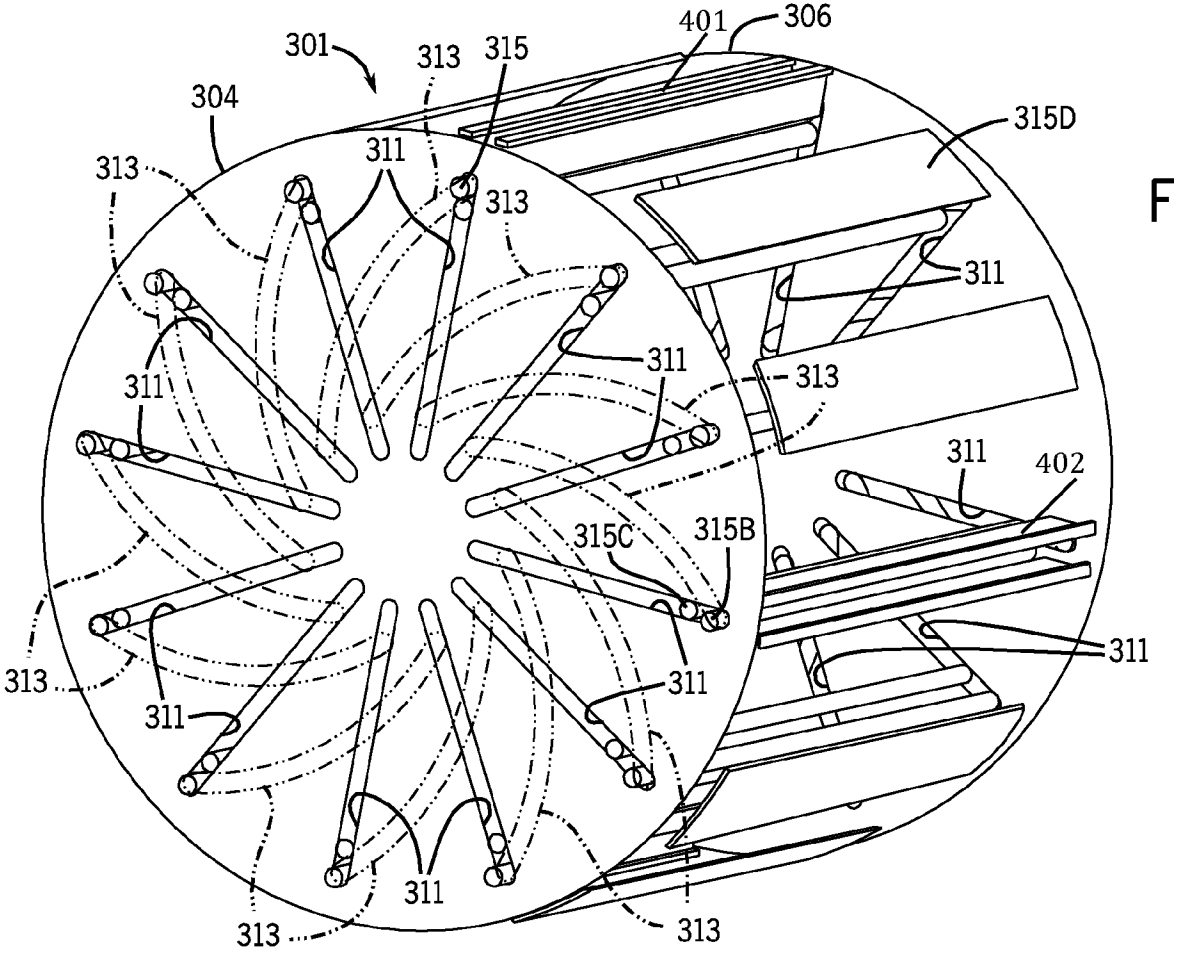
FIG. 5 is a perspective view of a drum in accordance with the preferred embodiment.

Turning now to FIGS. 3, 4 and 5, perspective views of a drum 301 are shown. The design is slightly different in FIGS. 3, 4, and 5, but each is in accordance with the preferred embodiment. Drum 301 includes two pairs of plates. The first pair include plates 303 and 304. The second pair of plates includes plate 306, and a plate behind plate 306, that corresponds to plate 303. FIGS. 4 and 5 show plate 304 and 306.

Plates 304 and 306 have a plurality of radial slots disposed therein. Plate 303 and the corresponding plate have non-radial grooves 313 disposed therein. The non-radial grooves are also represented on plate 304 in FIGS. 4 and 5 on (even though plate 303 is not shown) to illustrate the manner in which the drum diameter and bag length is changed. However, in the preferred embodiment the non-radial grooves are only on plate 303 and the corresponding plate, not on plates 304 and 306. Non-radial grooves, as used herein, is a groove that extends in a non-radial direction. Radial slots, as used herein, are slots that extend in a radial direction. Alternatives provide for the non-radial slots to be straight, curved, spiral, or other shapes. Other alternatives provide for the slots to be curved, and the grooves straight, or the grooves at an angle or pitch other than the slots, or grooves to be on plate 304 and slots on plate 303. Both can be non-radial, so long as they are angled or pitched with respect to one another.

Mounting fixtures 315 are associated with each groove and slot (one is shown as numbered, and the remainder are identical). Specifically, fixtures 315 include a guide block 315A (see on FIG. 3) which is attached to a guide 315B. Guide 315 B rests in both slot 311 and groove 313. When plate 304 is rotated with respect to plate 303, guide 315B moves in both slot 311 and groove 313. The non-radial configuration of groove 313 causes guides 315 to move toward or away from the center of plates 303 and 304.

A cross member 315D connects guide blocks 315A associated with plate 306 to the guide blocks 315A associated with plate 304. Thus, as plates 303 is rotated with respect to plate 304, and plate 306 rotated with respect to the other corresponding plate, and guide blocks 315A and guides 315B move toward or away from the center of plates 304 and 306, cross members 315D move toward or away from the center of drum 301. A guide 315C is provided only in slots 311 for added stability. Seal bars are mounted as desired on cross members 315D. Thus, the seal bars are also moved as the drum diameter changes. The preferred embodiment calls for 12 cross members and 4 seal bars. Seal bars 401 and 402 can be seen on FIGS. 4 and 5, and because there are 12 cross members and 4 seal bars, seal bar 401 is spaced from seal bar 402 by two cross members (12 cross members and 4 seal bars means every third cross member is covered by a seal bar).

Plates 303 and 304 are rotatable with respect to one another using a hand crank in the preferred embodiment. Two locking clamps 320 prevent rotation of the plates while the machine is running A coupler 322 connects the two pairs of plates to insure that the drum diameter is equal on both sides. A hand crank can be attached to the gear near clamp 320 to rotate the plates with respect to one another. Alternatives provide a motor used to adjust the discs or plates while running film or a hand crank could be used while machine is stopped. The plates are preferably constructed of zinc plated steel or galvanized steel, and are preferably ¼" thick "pickled and oiled" steel with slots/grooves cut with a laser.

Figure 6:
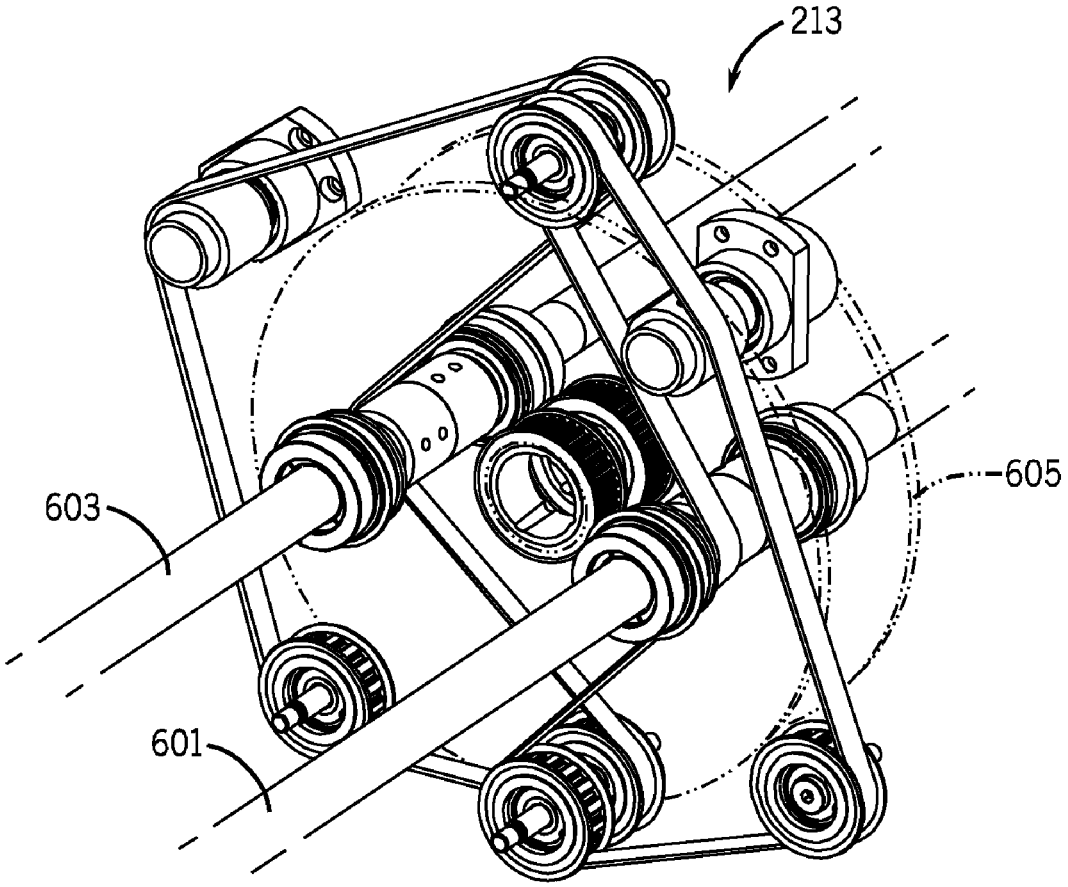
FIG. 6 is a perspective view of a winder in accordance with the preferred embodiment.
Figure 7:
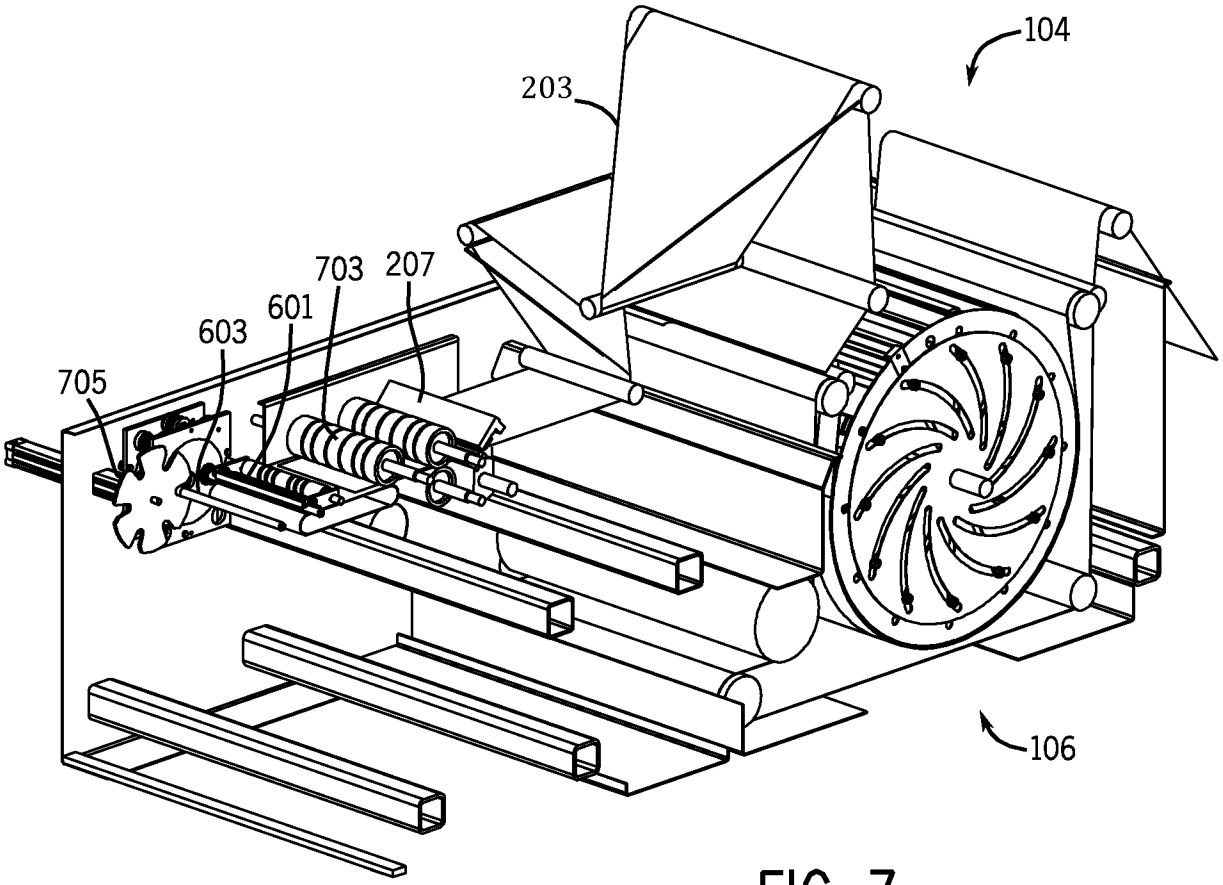
FIG. 7 is a perspective view of a bag machine in accordance with the preferred embodiment.

Turning now to FIGS. 6 and 7, a winder in accordance with the preferred embodiment includes spindles 601 and 603, mounted on a turret 605. Two spindles are provided because it is an economical design. In operation, the film approaches spindle 601. A conveyor 703 provides support for starting the winding process. A prior art airhorn may be used to facilitate starting.

After starting the turret does not move, and the roll continues to be wound in the starting position. If a perforation breaks the turret indexes and winding starts over on the other spindle. The winding is center and surface winding in the starting position, thus that position is a center and surface wind position. Center and surface wind position, as used herein, is a position on a turret where the winding is by both center winding and surface winding. Such winding generally provides a tighter wind. Center and surface winding may provide a nicer appearance on the surface of the roll even if the tension is set high.

After the roll is mostly wound, 75-95% wound in the preferred embodiment, the turret rotates such that spindle 601 moves to the position of spindle 603. The roll winding is completed here, with only center winding. Thus, the position spindle 603 is shown in is a center wind only position. The center wind only for the last 5-25% of the wind helps the push-off of the wound roll, and reduces the need for a third spindle position, and it provides for a simplified conveyor design, and the roll that is pushed off does not fall into the winding area. Center wind only position, as used herein, is a position on a turret where the winding is by center winding and not by surface winding. Such winding generally provides a looser wind. Center only winding may develop tension lines and in-line wrinkles if the tension is set too high.

A push off palm 705 removes the roll from the spindle in the position spindle 603 is shown. Push off palm 705 operates in accordance with the prior art. Because the roll is removed when the spindle is located where spindle 603 is shown, that position is also the push off position. The push off and center wind only positions are the same in the preferred embodiment, although they could be different. Push off position, as used herein, is a position on a turret where wound roll is pushed off the spindle, such as by a push off palm. A 360 degree scraper is used on each spindle instead of or with a push off palm in an alternative embodiment.

The push off position is such that the roll being pushed off will not interfere with winding because it is not above the center and surface winding position. Thus, when the roll falls, it will not hit another spindle. A position is not below another position, as used herein, when a roll being removed from the first position will not hit something in the second position. The preferred embodiment is that the turret is vertical, and the spindles are in a horizontal plane. The Figures show a preferred drive belt design so both spindles are driven and under the control of one of the two servo motors.

Alternatives provide for other arrangements, such as no turret with a single spindle and an upstream accumulator. Other alternatives includes turning the winder section so that the turret is in a horizontal plane or a diagonal plane.

Figure 8:
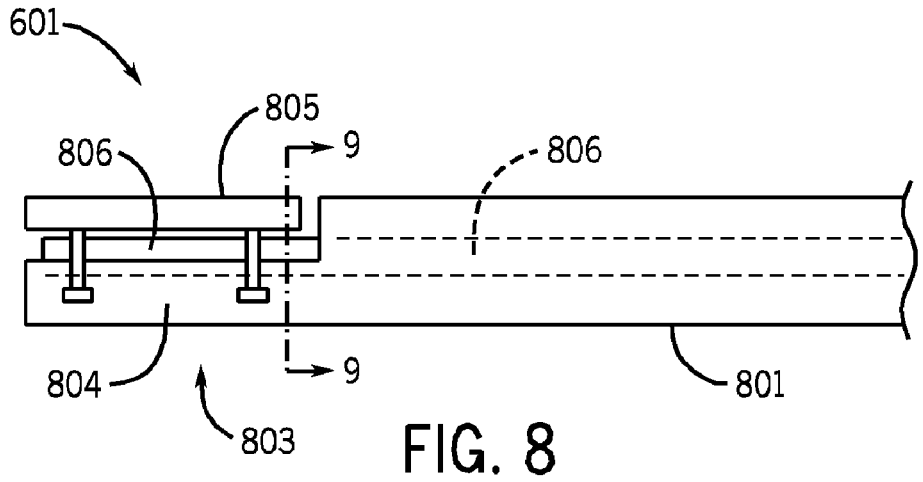
FIG. 8 is a side view of a spindle in accordance with the preferred embodiment.
Figure 9:
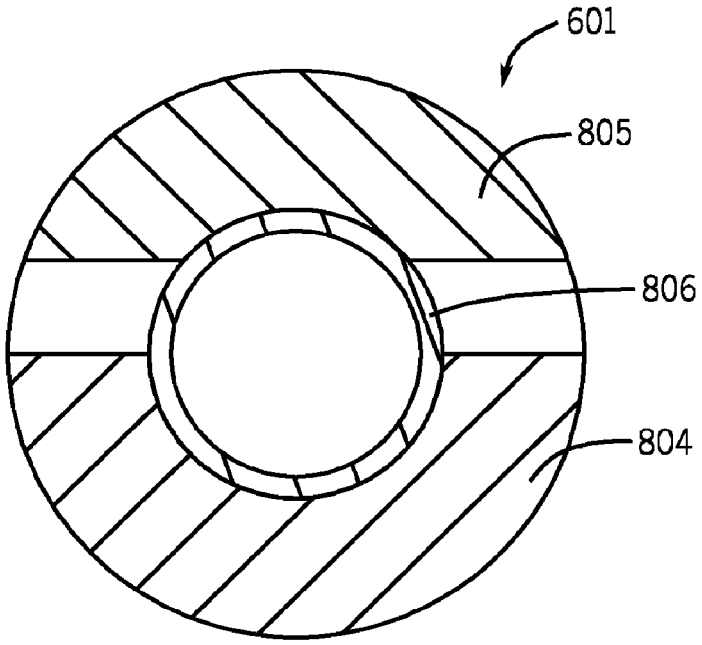
FIG. 9 is a cross sectional view of a spindle in accordance with the preferred embodiment.

Turning now to FIGS. 8 and 9, spindle 601 includes a first portion 801 and a second portion 803. Second portion 803 is preferably collapsible, and includes upper portion 805 and lower portion 804. A bladder 806 is disposed between the upper and lower portions. A fluid, such as air, is provided through an air channel 808 in portion 801. Thus, bladder 506 is fluidly connected to a source of fluid. Fluidly connected, as used herein, refers to a connection such that a fluid, including a gas, can pass from one part to the other. The spindles could be retrofitted to existing winders.

When winding, spindle 601 can be expanded (such as shown in FIG. 9), and when removing the roll, spindle 601 can be collapsed, for easier removal. Prior art spindles have been provided with air channels to direct the air to holes in the surface (for easier roll removal). This source of air can be used to inflate the bladder, as well as to be directed to holes in the surface of spindle 601 to make roll removal easier. One or more valves can be used to control air flow.

The preferred embodiment provides that the spindle is radially collapsible, although alternatives provide for other ways of collapsing. The preferred embodiment has portions 804 and 805 semi-annular in shape, such that when expanded a cross section of their outer periphery is a complete circle. Alternatives provide for other shapes. Radially collapsible, as used herein, means collapsible in a radial direction such that the circumference is reduced. Semi-annular shape, as used herein, is an annular shape cut in half by a diameter.

One alternative provides for spindle portion 803 having a rectangular, preferably square, cross section, and, when inflated, sections 804 and 805 are rectangular or square. Adhesive is applied to the film as it is being wound. Small count rolls such as 5-10 bags will produce a rectangular or square roll, and advertizing can be placed on each flat face. Also, the square or rectangular rolls can be stacked to eliminate the need for bags being put into a square/rectangular carton. A label may be is wrapped around the square roll before it is pushed off the square spindle. The use of a polyethylene printed label allows easier recycling (at the manufacturer) of rejected product without having to remove a paper label or band (usually done by hand).

Bladder 806 is preferably an air bladder, although liquids such as hydraulic fluids are used in alternative embodiments. Other alternatives include mechanical means, such as a linkage that runs through the middle of the spindle and is activated from one end of the spindle, or using a wedge design, or using a four bar linkage design.

Portions 804 and 805 are tapered in the preferred embodiment with a smaller diameter near the tip when deflated. Only one or the other, or neither, may be tapered in other embodiments.

Numerous modifications may be made to the present invention which still fall within the intended scope hereof. Thus, it should be apparent that there has been provided in accordance with the present invention a method and apparatus for a bag machine and or winder, and/or method of making or winding bags that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A bag machine for making bags from a tubular film, comprising:

an input section;

a drum section, including a drum, disposed to receive the film from the input section, and including at least one seal bar on the drum, wherein the seal bar forms bags by sealing the film;

an output section, disposed to receive the film from the drum section; and a first and second side frames, wherein the drum section is mounted to the first and second side frames, and further wherein the first side frame is a single metal plate and the second side frame is a single metal plate, and further wherein the first and second side frames are a bonding conductor.

2. The bag machine of claim 1, wherein the first and second side frames are not coated after being formed.

3. The bag machine of claim 2 wherein the first and second side frames are comprised of at least one of galvanized steel, galvannealed steel, stainless steel or aluminum.

4. The bag machine of claim 3 wherein the output section includes a folder and a winder.

5. The bag machine of claim 4 wherein the output section includes at least one of a perforator and a cut-off knife.

6. The bag machine of claim 5 wherein the drum section includes an adjustable diameter drum, whereby bag length is adjustable.

7. The bag machine of claim 3 wherein the output section is mounted to the first and second side frames.

8. The bag machine of claim 7 wherein the input section is mounted to the first and second side frames.

9. The bag machine of claim 1 wherein the at least one seal bar includes a perforator.

10. The bag machine of claim 1, wherein the first side frame is a single bonding conductor and the second side frame is a single bonding conductor and a third frame member connects the first side frame and the second side frame, wherein the third frame member is a bonding conductor.

11. The bag machine of claim 1 wherein the first and second side frames reduce the risk of Electrostatic Discharge (ESD) by providing a first and second bonding path to ground.

* * * * *